US011091857B2

(12) United States Patent
Siebert et al.

(10) Patent No.: US 11,091,857 B2
(45) Date of Patent: Aug. 17, 2021

(54) METHOD FOR WEAVING PILE FABRICS AND PILE FABRIC WOVEN WITH SUCH A METHOD

(71) Applicant: STAUBLI BAYREUTH GMBH, Bayreuth (DE)

(72) Inventors: Karsten Siebert, Weidenberg (DE); Bert Pols, Mijdrecht (NL)

(73) Assignee: STAUBLI BAYREUTH GMBH, Bayreuth (DE)

( * ) Notice: Subject to any disclaimer, the term of this patent is extended or adjusted under 35 U.S.C. 154(b) by 15 days.

(21) Appl. No.: 16/795,693

(22) Filed: Feb. 20, 2020

(65) Prior Publication Data

US 2020/0270779 A1 Aug. 27, 2020

(30) Foreign Application Priority Data

Feb. 26, 2019 (EP) ..... 19159443

(51) Int. Cl.
*D03D 27/10* (2006.01)
*D03D 39/16* (2006.01)
*D03D 11/00* (2006.01)

(52) U.S. Cl.
CPC ..... *D03D 27/10* (2013.01); *D03D 11/00* (2013.01); *D03D 39/16* (2013.01)

(58) Field of Classification Search
CPC ..... D03D 27/10; D03D 11/00; D03D 39/16; D03D 25/00; D03D 27/06; D03D 13/004; D03D 15/00; D03D 23/00; D03D 2700/60
See application file for complete search history.

(56) References Cited

U.S. PATENT DOCUMENTS 5,400,831 A * 3/1995 Gheysen ..... D03D 27/10 139/21
5,404,917 A * 4/1995 Gheysen ..... D03D 27/10 139/21
5,655,573 A * 8/1997 Gheysen ..... D03D 27/10 139/21
6,182,708 B1 * 2/2001 Smissaert ..... D03D 27/10 139/21
6,837,274 B2 * 1/2005 Debaes ..... D03D 27/10 139/102

(Continued)

FOREIGN PATENT DOCUMENTS

EP 1046734 A2 10/2000
EP 1072705 A2 1/2001

(Continued)

OTHER PUBLICATIONS

European Search Report dated Aug. 28, 2019 for Europe Application No. EP19159443 filed Feb. 26, 2019.

*Primary Examiner* — Robert H Muromoto, Jr.

(57) ABSTRACT

A method for simultaneously weaving, on a face-to-face weaving machine, two pile fabrics each including an area with and without pile. For a pick corresponding to the area without pile, a dead pile thread is placed between the backing fabric and a patterning weft and a dead pile thread is placed opposite the backing fabric with respect to the same patterning weft. An additional fabric is formed in the area without pile by the first and second dead pile threads woven with the patterning wefts, this additional fabric covering the backing fabric.

20 Claims, 7 Drawing Sheets

(56) References Cited

U.S. PATENT DOCUMENTS

| | | | | |
|---|---|---|---|---|
| 7,621,297 | B2 * | 11/2009 | Debaes | D03D 27/10 139/102 |
| 10,508,366 | B2 * | 12/2019 | Vanderjeugt | D03D 39/16 |
| 10,655,252 | B2 * | 5/2020 | Debaes | D03D 27/16 |
| 2002/0036021 | A1 * | 3/2002 | Goessl | D03D 27/10 139/2 |
| 2003/0226613 | A1 * | 12/2003 | Debaes | D03D 39/16 139/408 |
| 2004/0221915 | A1 * | 11/2004 | Debaes | D03D 27/10 139/409 |
| 2008/0053557 | A1 * | 3/2008 | Debaes | D03D 27/10 139/404 |
| 2018/0171517 | A1 * | 6/2018 | Debaes | D03D 27/16 |
| 2018/0320295 | A1 * | 11/2018 | Vanderjeugt | D03C 3/26 |
| 2019/0010636 | A1 * | 1/2019 | Vanderjeugt | D03D 27/10 |
| 2020/0123686 | A1 * | 4/2020 | Schnabel | D03D 39/18 |

FOREIGN PATENT DOCUMENTS

| | | | |
|---|---|---|---|
| EP | 1347087 | A2 | 9/2003 |
| EP | 2568065 | A1 | 3/2013 |

* cited by examiner

METHOD FOR WEAVING PILE FABRICS AND PILE FABRIC WOVEN WITH SUCH A METHOD

TECHNICAL FIELD OF INVENTION

This invention relates to a method for simultaneously weaving, on a face-to-face weaving machine, two pile fabrics, each pile fabric including at least one area with pile and at least one area without pile. This invention also relates to a pile fabric which includes at least one area with pile and at least one area without pile and which can be woven with such a method.

BACKGROUND OF THE INVENTION

In the field of carpet weaving on face-to-face looms, EP-A-1 046 734 discloses carpet weaving methods allowing to obtain pile fabrics with cut pile and some zones of flat weaving. In these flat weaving zones, the dead pile threads follow a patterning path in the backing fabric and can define different patterns, respectively on the top fabric and on the bottom backing fabric. In these zones, the patterning dead pile threads run around inner wefts incorporated into the backing fabrics, so that the binding warp threads remain visible on the woven fabric.

On the other hand, EP-A-1 072 705 discloses carpet weaving methods with mixed cut pile and false bouclé. In a zone without pile of the fabric, the dead pile threads form ribs around wefts which are inserted alongside the backing fabrics. The patterning dead pile threads are in-woven along the back wefts of the backing fabric. As a consequence, in a zone without pile, some ribs are formed on the front side of the backing fabric, by the patterning dead pile threads turning around the wefts. The top surface of a zone of the fabric without pile is not flat.

On the other hand, EP-A-2 568 065 discloses carpet weaving methods with mixed cut pile zones and flat weaving zones, that is zones without pile. In the flat weaving zones, the dead pile threads are used to selectively hide some inner wefts. These inner wefts are incorporated into the backing fabric, so that they remain visible on the top surface of the backing fabric, in a flat weaving zone.

In addition, EP-A-1347087 discloses a weaving method where two different structures of the piles are used, namely pile loops and cut piles. Some pile yarns are woven around loop weft yarns, which are subsequently removed.

With the known techniques, the front surface of a zone without pile of a pile fabric is not completely smooth and shows binding warp threads and/or wefts, which is not optimal in terms of esthetics.

SUMMARY OF THE INVENTION

This invention aims at solving this problem with a new method for simultaneously weaving two pile fabrics, which allows obtaining a smooth surface on the front face of a pile fabric in a flat weaving zone of the pile fabric, where no pile is present.

To this end, the invention relates to a method for simultaneously weaving, on a face-to-face weaving machine, two pile fabrics including each at least one area with pile and at least one area without pile. A top fabric and a bottom fabric are woven one above the other, each with at least one tension warp thread, at least one binding warp thread, inner wefts, inserted between the binding warp thread and the tension warp thread on a pile side of the tension warp thread, and back wefts, inserted between the binding warp thread and the tension warp thread on a back side of the tension warp thread, opposite to the piles of the fabric. Moreover, patterning wefts are inserted on the pile side of the tension warp thread, outside of the backing fabric, and at least one patterning pile thread is interlaced in the upper backing fabric and in the lower backing fabric, in order to form pile legs in the area with pile. According to the invention, for at least one pick corresponding to the area without pile, at least a first dead pile thread is placed between the backing fabric and a patterning weft, whereas a second dead pile thread is placed opposite the backing fabric with respect to the same patterning weft. An additional fabric is formed in the area without pile by the first and second dead pile threads woven with the patterning wefts. This additional fabric covers the backing fabric.

In the present description and in the attached set of claims, a weft can also be called a weft yarn or weft thread; a dead pile thread can also be called a dead pile yarn, a binding warp thread can also be called a binding warp yarn, a tension warp thread can also be called a tension warp yarn and a patterning pile thread can also be called a patterning pile yarn.

In the meaning of the invention, the expression "dead pile thread" designates every pile thread which is selectable for forming a pile in an area with pile but which is not selected for forming a pile at a given pick.

Owing to the invention, the additional fabric hides the binding warp threads and any rib formed on the backing fabric, from the pile side of the pile fabrics. Moreover, the additional fabric can provide weft and warp effects. In other words, the additional fabric allows improving the esthetics of the pile fabric in the area without pile.

According to advantageous but optional aspects of the invention, such a weaving method may incorporate one or several of the following features, considered in any technically allowable combination:

- The pile threads are grouped, along the weft direction, in pile yarn sets going through a same reed dent space of a reed of the face-to-face weaving machine, and the first dead pile thread and the second dead pile thread, which are placed on either side of a same patterning weft during said at least one pick, belong to the same pile yarn set.
- The pile threads are organized, along the weft direction, in respective pile yarn sets with all pile warp threads of one pile yarn set going through a same reed dent space of a reed of the face-to-face weaving machine, and the first dead pile thread and the second dead pile thread, which are placed on either side of a same patterning weft during said at least one pick, belong to different warp yarn sets.
- An area without pile is woven with several adjacent pile yarn sets.
- During weaving of the area without pile, a dead pile thread follows a tying path where, for at least one pick, it is placed between an inner weft and a back weft of the backing fabric and, for at least another pick, it is placed opposite the backing fabric with respect to a patterning weft.
- At the other pick where the dead pile thread is placed opposite the backing fabric with respect to the patterning weft, another dead pile thread, which belongs to the same pile yarn set as the dead pile thread following the tying path, is placed opposite the backing fabric with respect to a patterning weft.

The method is implemented on a weaving machine with two weft insertion means and wefts are inserted into a top shed and into a bottom shed formed on the loom, during successive series of three picks and, preferably, at a first pick of a series of three picks, one patterning weft is inserted into each shed;

at a second pick of the same series, one back weft is inserted into the top shed and one inner weft is inserted into the bottom shed; and at a third pick of the same series, one inner weft is inserted into the top shed and one back weft is inserted into the bottom shed.

The method is implemented on a weaving machine with two weft insertion means and wefts are inserted into a top shed and into a bottom shed formed on the loom, during successive series of four picks and, preferably, at a first pick of a series of four picks, one back weft is inserted into the top shed and one patterning weft is inserted into the bottom shed;

at a second pick of the same series, one back weft is inserted into the bottom shed and one patterning weft is inserted into the top shed;

at a third pick of the same series, one inner weft is inserted into the top shed and one patterning weft is inserted into the bottom shed; and at the fourth pick of the same series, one inner weft is inserted into the bottom shed and one patterning weft is inserted into the top shed.

The method is implemented on a weaving machine with three weft insertion means and wefts are inserted into a top shed, into a middle shed and into a bottom shed formed on the loom, during successive series of two picks and, preferably, at the first pick of a series of two picks, one back weft is inserted into the top shed, one patterning weft is inserted into the middle shed and one inner weft is inserted into the bottom shed and both the back weft and the patterning weft are incorporated into the top pile fabric; and at a second pick of the same series, one back weft is inserted into the bottom shed, one patterning weft is inserted into the middle shed and one inner weft is inserted into the top shed and both the back weft and the patterning weft are incorporated into the bottom pile fabric.

The patterning wefts are divided into at least two different types of patterning wefts, in particular patterning wefts of different colours or materials which alternate along the warp direction forming groups of patterning wefts.

For at least one pick corresponding to the area without pile, at least a first dead pile warp thread is placed between the backing fabric and a patterning weft of a first type and a second dead pile warp thread is placed opposite the backing fabric with respect to the same patterning weft of a first type and the patterning weft of a second type of the same group is placed between the first and second dead pile threads and the tension warp thread.

The method is implemented on a weaving machine with two weft insertion means and that wefts are inserted into a top shed and into a bottom shed formed on the loom, during successive series of four picks and, preferably, at a first pick of a series of four picks, one patterning weft of a first type is inserted into the top shed and one inner weft is inserted into the bottom shed;

at a second pick of the same series, one patterning weft of a second type is inserted into the top shed and one back weft is inserted into the bottom shed;

at a third pick of the same series, one patterning weft of the first type is inserted into the bottom shed and one back weft is inserted into the top shed; and at a fourth pick of the same series, one patterning weft of the second type is inserted into the bottom shed and one inner weft is inserted into the top shed.

In an area without pile, dead pile threads of two different types are respectively woven with the two types of patterning wefts.

This invention also relates to a pile fabric including at least one area with pile and at least one area without pile. This pile fabric comprises a backing fabric woven with at least one tension warp thread, at least one binding warp thread, inner wefts, inserted between the binding warp thread and the tension warp thread on the pile side of the tension warp thread, and back wefts, inserted between the binding warp thread and the tension warp thread on a back side of the tension warp thread, opposite to the pile of the fabric. The pile fabric also includes patterning wefts inserted on the pile side of the tension warp threads, outside of the backing fabric, and pile legs in the area with pile. According to the invention, the pile fabric includes, in the area without pile, an additional fabric different from the backing fabric and woven with a weaving scheme where at least a first dead pile thread is located between the backing fabric and a patterning weft, whereas a second dead pile warp thread is located opposite the backing fabric with respect to the same patterning weft, this weaving scheme being used several times in the weft direction.

Advantageously, in the area without pile, a dead pile thread follows a path where, in a first zone of the area without pile, it is located between an inner weft and a back weft of the backing fabric and, in another zone of the area without pile, it is located opposite the backing fabric with respect to a patterning weft.

According to another optional aspect of the invention, the patterning wefts are divided into at least two different types, in particular of different colours or materials.

BRIEF DESCRIPTION OF THE DRAWINGS

The invention will be better understood and other advantages therefore will appear more clearly upon reading of the following description of several embodiments of a weaving method and a fabric according to its principle, provided solely as an example and made in reference to the appended drawings in which.

DETAILED DESCRIPTION OF SOME EMBODIMENTS

Figure 1:
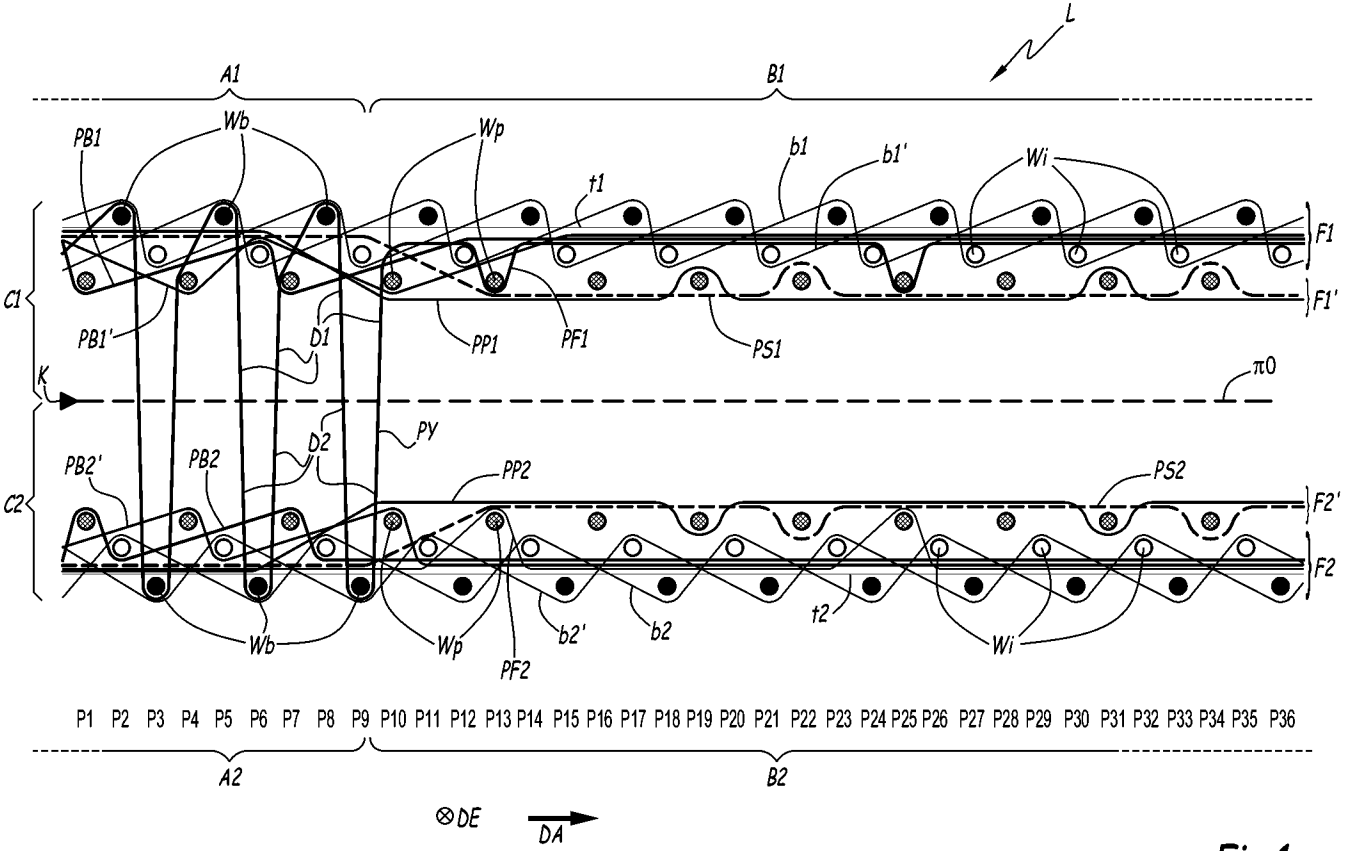
FIG. 1 is a schematic cross-section along the warp direction of two pile fabrics according to the invention, woven on a face-to-face weaving machine, this cross-section representing a first weaving method according to the invention.

FIG. 1 is a schematic cross-section, in the warp direction, of two carpets C1 and C2 simultaneously woven one above the other on a face-to-face weaving machine or loom L. This face-to-face weaving machine L includes two non-represented insertion means, e.g. in the form of rapiers.

Picks P1 to P36 are represented in FIG. 1 and define insertion cycles for wefts.

Carpets C1 and C2 are according to the invention. Each carpet C1 or C2 includes a backing fabric F1, respectively F2, and pile legs D1, respectively D2, extending from one backing fabric F1 or F2 towards the other backing fabric F2 or F1 in the configuration of FIG. 1. Backing fabrics F1 and F2 might also be called ground fabrics.

Carpet C1 includes one or more area(s) A1 with pile legs D1 and one or more area(s) B1 without pile. Similarly, carpet C2 includes one or more area(s) A2 with pile legs D2 and one or more area(s) B2 without pile.

Pile legs D1 and D2 are separated from each other by a knife K which belongs to a not further represented cutting device of weaving machine L. Knife K travels along a median plane Π0 of the weaving machine. Plane Π0 extends parallel to and between backing fabrics F1 and F2. It is equidistant from these two fabrics.

Backing fabric F1 includes two binding warp threads b1 and b1' and a tension warp thread t1. Backing fabric F2 includes two binding warp threads b2 and b2' and a tension warp thread t2. Alternatively, several tension warp threads can be used in one or each backing fabric.

The warp threads also include pile warp threads which can extend from one backing fabric to the other, in order to form pile legs D1 and D2, as represented by pile warp threads PY in FIG. 1. Other pile threads PB1 and PB1' constitute dead pile threads which remain in baking fabric F1 during picks P1 to P36. Similarly, dead pile threads PB2 and PB2' remain in backing fabric F2 during picks P1 to P36.

The binding warp threads b1 and b1' and tension warp thread t1 together form a group of warp threads devoted to backing fabric F1. Similarly, binding warp threads b2 and b2' and tension warp thread t2 together form a group of warp threads devoted to backing fabric F2. Binding warp threads and tension warp threads are drawn in through heddles which are mounted in heddle frames connected to a non-represented shedding device of weaving machine L, such as a dobby or a cam machine.

Another pile thread, PF2, is a dead pile thread between picks P1 and P36 and it is incorporated in backing fabric F2, placed between inner wefts Wi and back wefts Wb, between picks P1 and P11, between picks P14 and P23 and between picks P26 and P36.

The dead pile threads PP1 and PS1 are incorporated in backing fabric F1 at picks P1 to P9. Similarly, dead pile threads PP2, PS2 and PF2 are incorporated within backing fabric F2 at picks P1 to P8.

The warp threads PP1, PS1, PP2, PS2 and PF2 can be used to create pile in a non-represented part of carpets C1 and C2 before or after picks P1 to P36.

The pile threads PY, PB1, PB1', PB2, PB2', PP1, PS1, PP2, PS2 and PF2 are fed from a creel and drawn in through heddles driven by a non-represented Jacquard mechanism of weaving machine L.

A top shed is defined between some warp threads placed by their respective heddles into a top position and a middle position. A bottom shed is defined between some warp threads placed by their respective heddles into a middle position and a bottom position.

The binding warp threads, tension warp threads and pile threads are grouped into warp yarn sets which extend side by side in the weft direction, which is in a direction perpendicular to the plane of FIG. 1. This direction is represented in FIG. 1 with cross DE, whereas arrow DA represents a warp direction perpendicular to weft direction DE. Directions DA and DE are oriented. In particular, direction DA goes from pick P1 towards pick P36.

All the threads of one warp yarn set go through the same reed dent space of a non-represented reed of the weaving machine L. All the warp threads represented in FIG. 1, that is binding warp threads b1, b1', b2 and b2', tension warp threads t1 and t2 and pile threads PY, PB1, PB1', PB2, PB2', PP1, PS1, PP2, PS2 and PF2 belong to the same warp yarn set.

Each area A1 or A2 with pile comprises several warp yarn sets, adjacent in the weft direction DE. Each area B1 or B2 without pile comprises several warp yarn sets, adjacent in the weft direction DE.

At each pick P1 to P36, one weft is inserted into the top shed and one weft is inserted into the bottom shed by two non-represented insertion means which travel into the top and bottom sheds. This insertion means can include rapiers or any similar device.

The wefts include inner wefts Wi which can also be called "front" wefts, since they are oriented, with respect to backing fabric F1 or F2, towards the front of carpet C1 or C2, that is towards median plane no. The wefts also include back wefts Wb which can also be called "outer" wefts, since they are oriented towards the outside of a space defined between backing fabrics F1 and F2 in the configuration of FIG. 1. Inner wefts Wi are located, in each backing fabric, on the same side as the pile legs D1 or D2 with respect to the tension warp threads t1 or t2. Back wefts Wb are located, in each backing fabric F1 or F2, opposite the pile legs D1 and D2 with respect to the tension warp threads t1 or t2.

The wefts also include patterning wefts Wp which are not bound by binding warp threads b1, b1' to backing fabric F1 or by binding warp threads b2, b2' to backing fabric F2. Patterning wefts Wp are located, with respect to the adjacent backing fabric F1 or F2, on the same side as the inner wefts Wi of the backing fabric. Thus, the patterning weft Wp extend, in the weft direction DE, along the front side, or pile side, of the backing fabrics F1 and F2.

While inserting a patterning wefts Wp in the top carpet C1, the weft insertion means, for example a rapier, is not supported nor guided by any binding warp threads. The preferred option to solve this issue is to use a gliding pad under the rapier and let the rapier glide over the lancets, provided the loom is equipped with lancets. An alternative way to support the insertion means is to move the binding warp threads b2, b2' dedicated to the bottom fabric F2 to a position, higher than the usual middle position, such that they support the insertion means. A third option is to equip the loom with special support threads, located near the top fabric F1 between the top and bottom fabrics F1, F2 which support the insertion means when a patterning weft Wp is inserted in the top carpet C1.

At pick P1, a patterning weft Wp is inserted into the bottom shed and another patterning weft Wp is inserted into the top shed. In the top shed, the binding threads b1 and b1', the tension warp thread t1 and the pile threads PY, PB1', PP1 and PS1 are in a top position. Dead pile thread PB1' is in the middle position. In the bottom shed, the binding threads b2 and b2', the tension warp threads t2 and the pile threads PB2', PP2, PS2 and PF2 are in the bottom position. Pile thread PB2 is in the middle position.

At pick P2, an inner weft Wi is inserted in the bottom shed and a back weft Wb is inserted into the top shed. In the top shed, binding warp thread b1' and the patterning pile thread PY are in the top position. The other warp threads forming carpet C1 are in the middle position. In the bottom shed, dead pile thread PB2' and the binding warp thread b2 are in the middle position. The other warp threads forming carpet C2 are in the bottom position.

At pick P3, the back weft Wb is inserted into the bottom shed and an inner weft Wi is inserted into the top shed. In the top shed, binding warp thread b1' and the dead pile thread PB1 and PB1' are in the middle position. The other warp threads forming carpet C1 are in the top position. In the bottom shed, patterning pile thread PY and the binding warp thread b2' are in the bottom position; the other warp threads forming carpet C2 are in the middle position.

At pick P4, a patterning weft Wp is inserted into the bottom shed and another patterning weft Wp is inserted into the top shed. In the top shed, the dead pile thread PB1' is in the middle position. The other warp threads forming carpet C1, including the patterning pile thread PY, are in the top position. In the bottom shed, the dead pile thread PB2' is in the middle position. The other warp threads forming carpet C2 are in the bottom position.

At pick P5, an inner weft Wi is inserted into the bottom shed and a back weft Wb is inserted into the top shed. In the top shed, the binding warp thread b1 and the patterning pile thread PY are in the top position. The other warp threads forming carpet C1 are in the middle position. In the bottom shed, the dead pile thread PB2 and the binding warp thread b2' are in the middle position. The other warp threads forming carpet C2 are in the bottom position.

At pick P6, a back weft Wb is inserted into the bottom shed and an inner weft Wi is inserted into the top shed. In the top shed, the binding warp thread b1 is in the middle position. The other warp threads forming carpet C1 are in the top position. In the bottom shed, the binding warp thread b2 and the patterning pile thread PY are in the bottom position. The other warp threads forming carpet C2 are in the middle position.

At pick P7, a patterning weft Wp is inserted in the bottom shed and another patterning weft Wp is inserted in the top shed. In the top shed the dead pile thread PB1 is in the middle position. The other warp threads forming carpet C1, including the patterning pile thread PY, are in the top position. In the bottom shed, the dead pile thread PB2 is in the middle position. The other warp threads forming carpet C2 are in the bottom position.

At pick P8, an inner weft Wi is inserted into the bottom shed and a back weft Wb is inserted into the top shed. In the top shed, binding warp thread b1' and a patterning pile thread PY are in the top position. The other warp threads forming carpet C1 are in the middle position. In the bottom shed, the dead pile threads PB2' and PP2 and the binding warp thread b2 are in the middle position. The other warp threads forming carpet C1 are in the bottom position.

At pick P9, a back weft Wb is inserted into the bottom shed and an inner weft Wi is inserted into the top shed. In the top shed, the binding warp thread b1, the tension warp thread t1 and the dead pile thread PS1 are in the top position. The other warp threads forming carpet C1 are in the middle position. In the bottom shed, the binding warp thread b2' and the patterning pile thread PY are in the bottom position. The other warp threads forming carpet C2 are in the middle position.

At pick P10, a patterning weft Wp is inserted into the bottom shed and another patterning weft Wp is inserted into the top shed. In the top shed, the dead pile threads PB1' and PP1 are in the middle position. The other warp threads forming carpet C1, including the patterning pile thread PY are in the top position. In the bottom shed, the dead pile thread PB2' and PP2' are in the middle position. The other warp threads forming carpet C2 are in the bottom position.

At pick P11, an inner weft Wi is inserted into the bottom shed and a back weft Wb is inserted into the top shed. In the top shed, the binding warp thread b1 is in the top position. The other warp threads forming carpet C1 are in the middle position. In the bottom shed, the binding warp thread b2' and the dead pile threads PP2 and PS2 are in the middle position. The other warp threads forming carpet C2 are in the bottom position.

At pick P12, a back weft Wb is inserted into the bottom shed and an inner weft Wi is inserted into the top shed. In the top shed, the binding warp thread b1 and the pile threads PP1, PS1 and PB1' are in the middle position. The other warp threads forming carpet C1 are in the top position. In the bottom shed, the binding warp thread b2 is in the bottom position. The other warp threads forming carpet C2 are in the middle position.

At pick P13, a patterning weft Wp is inserted into the bottom shed and another patterning weft Wp is inserted into the top shed. In the top shed, the pile threads PP1, PS1 and PY are in the middle position. The other warp threads forming carpet C1 are in the top position. In the bottom shed, the pile threads PP2, PS2 and PF2 are in the middle position. The other warp threads forming carpet C2 are in the bottom position.

At pick P14, an inner weft Wi is inserted into the bottom shed and a back weft Wb is inserted into the top shed. In the top shed, the binding warp thread b1' is in the top position. The other warp threads forming carpet C1 are in the middle position. In the bottom shed, the binding warp thread b2 and the dead pile thread PP2 and PS2 are in the middle position. The other warp threads forming carpet C2 are in the bottom position.

At pick P15, a back weft Wb is inserted into the bottom shed and an inner weft Wi is inserted into the top shed. In the top shed, the binding warp thread b1' and the dead pile threads PP1 and PS1 are in the middle position. The other warp threads forming carpet C1 are in the top position. In the bottom shed, the binding warp thread b2' is in the bottom position. The other warp threads forming carpet C2 are in the middle position.

At pick P16, a patterning weft Wp is inserted into the bottom shed and another patterning weft Wp is inserted into the top shed. In the top shed, the dead pile threads PP1 and PS1 are in the middle position. The other warp threads forming carpet C1 are in the top position. In the bottom shed, the dead pile threads PP2 and PS2 are in the middle position. The other warp threads forming carpet C2 are in the bottom position.

At pick P17, an inner weft Wi is inserted into the bottom shed and a back weft Wb is inserted into the top shed. In the top shed, the binding warp thread b1 is in the top position. The other warp threads forming carpet C1 are in the middle position. In the bottom shed, the binding warp thread b2' and the dead pile threads PP2 and PS2 are in the middle position. The other warp threads forming carpet C2 are in the bottom position.

At pick P18, a back weft Wb is inserted into the bottom shed and an inner weft Wi is inserted into the top shed. In the top shed, the binding warp thread b1 and the dead pile threads PP1 and PS1 are in the middle position. The other warp threads forming carpet C1 are in the top position. In the bottom shed, the binding warp thread b2 is in the bottom position. The other warp threads forming carpet C2 are in the middle position.

At pick P19, a patterning weft Wp is inserted into the bottom shed and another patterning weft Wp is inserted into the top shed. In the top shed, dead pile thread PS1 is in the middle position. The other warp threads forming carpet C1 are in the top position. In the bottom shed, dead pile thread PS2 is in the middle position. The other warp threads forming carpet C1 are in the bottom position.

At pick P20, an inner weft Wi is inserted into the bottom shed and a back weft Wb is inserted into the top shed. In the top shed, the binding warp thread b1' is in the top position. The other warp threads forming carpet C1 are in middle position. In the bottom shed, the binding warp thread b2 and the dead pile threads PP2 and PS2 are in the middle position. The other warp threads forming carpet C2 are in the bottom position.

At pick P21, a back weft Wb is inserted into the bottom shed and an inner weft Wi is inserted into the top shed. In the top shed, the binding warp thread b1' and the dead pile threads PP1 and PS1 are in the middle position. The other warp threads forming carpet C1 are in top position. In the bottom shed, the binding warp thread b2' is in the bottom position. The other warp threads forming carpet C1 are in the middle position.

At pick P22, a patterning weft Wp is inserted into the bottom shed and another patterning weft Wp is inserted into the top shed. In the top shed, the dead pile thread PP1 is in the middle position. The other warp threads forming carpet C1 are in the top position. In the bottom shed, the dead pile thread PP2 is in the middle position. The other warp threads forming carpet C1 are in the bottom position.

At pick P23, the situation is as at pick P17.

At pick P24, a back weft Wb is inserted into the bottom shed and an inner weft Wi is inserted into the top shed. In the top shed, the binding warp thread b1 and the dead pile threads PP1 and PS1 are in the middle position. The other warp threads forming carpet C1 are in top position. In the bottom shed, the binding warp thread b2 is in the bottom position. The other warp threads forming carpet C1 are in the middle position.

At pick P25, a patterning weft Wp is inserted into the bottom shed and another patterning weft Wp is inserted into the top shed. In the top shed, the dead pile threads PP1, PY and PS1 are in the middle position. The other warp threads forming carpet C1 are in the top position. In the bottom shed, the dead pile threads PP2, PF2 and PS2 are in the middle position. The other warp threads forming carpet C2 are in the bottom position.

At pick P26, the situation is as at pick P20.

This goes on up to pick P36.

As can be derived from the above-mentioned explanations and from FIG. 1, pile threads pattern in three revolutions. On the other hand, the binding warp threads b1, b1', b2 and b2' follow a pattern of six picks.

As explained here-above, wefts Wi, Wb and Wp are inserted in successive series of three picks. At a first pick P1, P4, P7, . . . of such a series of three picks, one patterning weft Wp is inserted in each shed. At the second pick P2, P5, P8, . . . of the same series, one back weft Wb is inserted into the top shed and one inner weft Wi is inserted into the bottom shed. At the third pick, P3, P6, P9 . . . , of the same series, one inner weft Wi is inserted into the top shed and one back weft Wb is inserted into the bottom shed.

From pick P1 to pick P10, the patterning pile thread PY is interlaced into the top fabric F1 and into the bottom fabric F2. This allows forming pile legs D1 and D2 after the cutting operation performed with knife K.

From pick P10 to pick P36, dead pile threads PP1 and PS1 are either located between backing fabric F1 and an adjacent patterning weft Wp or opposite the backing fabric with respect to such a patterning weft. In particular, at picks P19 and P31, dead pile thread PP1 is between patterning weft Wp and backing fabric F1, whereas dead pile thread PS1 is opposite backing fabric F1 with respect to patterning weft Wp. The situation is reverse at pick P22 and P34 where dead pile warp thread PS1 is between backing fabric F1 and patterning weft Wp and dead pile warp thread P1 is opposite backing fabric F1 with respect to patterning weft Wp. Regarding the lower carpet C2, a comparable situation can be observed. At picks P19 and P31, dead pile thread PP2 is between backing fabric F2 and patterning weft Wp, whereas dead pile thread PS2 is opposite the backing fabric with respect to the same patterning weft. At picks 22 and 34, the situation is reversed: dead pile warp thread PS2 is located between backing fabric F2 and patterning weft Wp whereas dead pile warp thread PP2 is opposite backing fabric F2 with respect to patterning weft Wp.

Thanks to the path of dead pile threads PP1 and PS1 with respect to patterning wefts Wp, an additional fabric F1' is woven on the front or pile side of backing fabric F1. Similarly, an additional fabric F2' is woven on the pile side of backing fabric F2. In other words, the weaving scheme visible between picks P10 and P36 in FIG. 1 allows, when used several times in the weft direction, to create additional fabrics F1' and F2'.

Additional fabrics F1' and F2' allow hiding the binding warp threads b1, b1', b2, b2', respectively in backing fabrics F1 and F2, which improves the esthetics of carpets C1 and C2 in their zones B1 and B2 without pile, when seen from their front side.

Moreover, depending on the material used for patterning wefts Wp and dead pile threads PP1, PS1, PP2, PS2, some patterning effects can be obtained, which further improves the esthetics of carpets C1 and C2.

At picks P13 and P25, dead pile thread PF2 is in the middle position, so that it ties patterning weft Wp to backing fabric F2. At the other picks, between picks P10 and P36, this dead pile thread PF2 is placed between inner wefts Wi and back wefts Wb, that is integrated within backing fabric F2. Thus, dead pile thread PF2 ties, or anchors some patterning wefts Wp to the inner wefts Wi of backing fabrics F2. This way, it is avoided that a large surface of the additional fabric F2' floats over the backing fabric F2, with the risk of being easily scrapped or being too loose.

The same situation prevails in carpet C1 where the portion of pile thread PY integrated into carpet C1 after pick P10 follows a path symmetrical to the path of dead pile thread PF2 with respect to median plane no. In other words, as from pick P10, pile thread PY forms a dead pile thread PF1 which fulfills a function similar to the one of dead pile thread PF2, that is tying or anchoring additional fabric F1' to backing fabric F1 at some picks.

According to a non-represented alternative embodiment of the invention, a dedicated dead pile warp thread can be used, instead of a portion of patterning pile thread PY, in order to connect some patterning wefts Wp to the backing fabrics F1.

At picks P13 and P25, dead pile threads PF1 and PF2, used for tying the patterning wefts Wp to the backing fabric, are covered by the dead pile threads PP1, PS1, respectively PP2, PS2, so that dead pile threads PF1 and PF2 do not alter the appearance of the additional flat fabrics F1' and F2'.

In the embodiment described here-above, dead pile threads PS1 and PS2 belong to the same warp yarn set as threads PP1 and PP2. This allows efficiently hiding the patterning weft Wp within the width of the carpets C1 and C2, along the weft direction DE.

However, alternatively, it is possible for dead pile threads PS1 and PS2 to be part of a pile yarn set different from, but adjacent to, the pile yarn set which includes dead pile threads PP1 and PP2. In such a case, the patterning wefts Wp may be visible and provide a different appearance.

In the second to fifth embodiments respectively represented in FIGS. 2 to 7, the same elements as in the first embodiment bear the same references and are used in the same way.

Here-after, one focuses on the differences between the second to fifth embodiments and the first embodiment.

Figure 2:
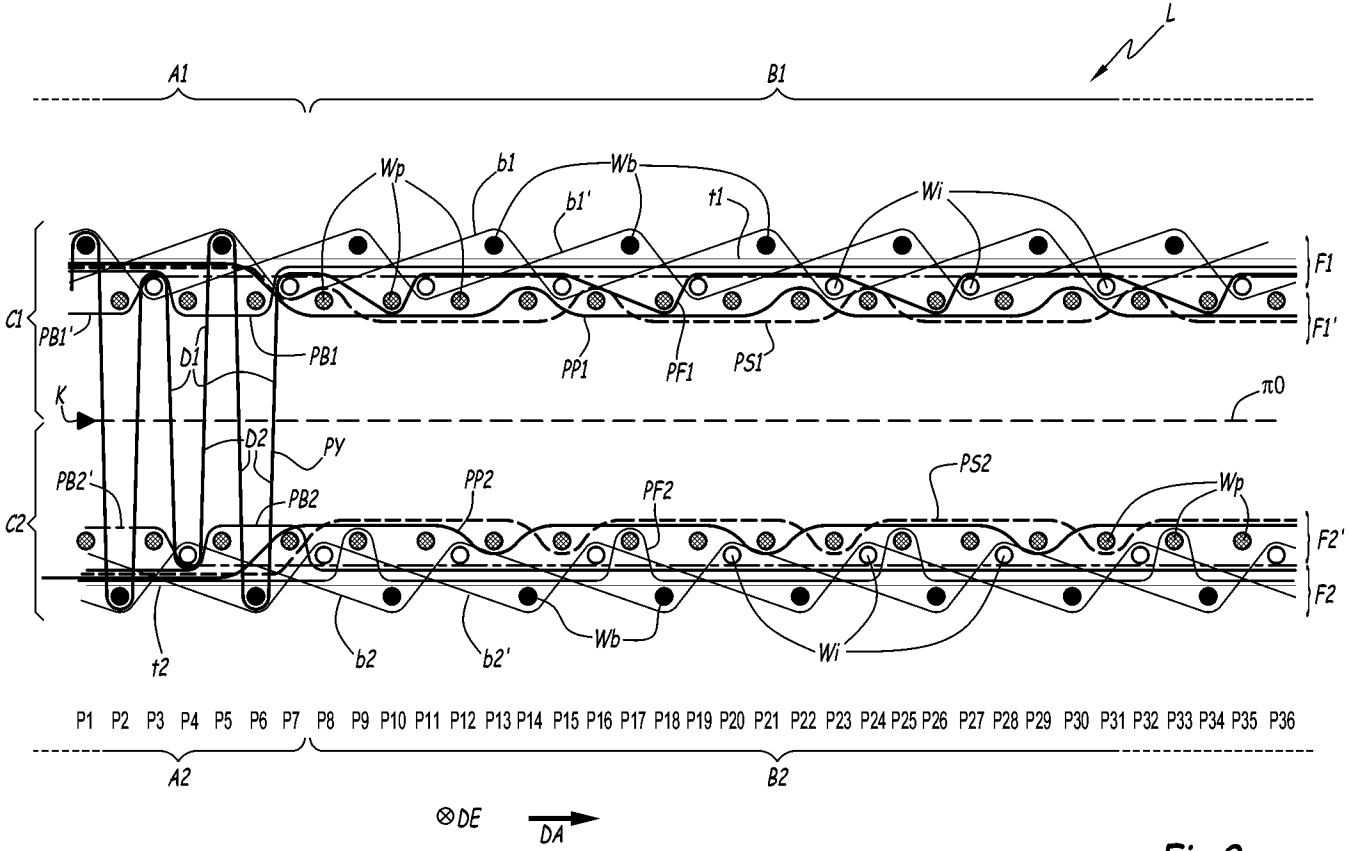
FIGS. 2, 3, 4 and 6 are cross-sections similar to FIG. 1 representing respectively a second, a third, a fourth and a fifth weaving method and further pile fabrics according to the invention

In the second embodiment, shown in FIG. 2, the wefts Wi, Wb and Wp are inserted in successive series of four picks. At a first P1, P5, P9, . . . of a series of four picks, one back weft Wb is inserted in the top shed and one patterning weft Wp is inserted into the bottom shed. At a second pick P2, P6, P10, . . . of the same series of picks, one back weft Wb is inserted into the bottom shed and one patterning weft Wp is inserted into the top shed. At a third pick P3, P7, P11, . . . of the same series of picks, one inner weft Wi is inserted into the top shed and one patterning weft Wp is inserted into the bottom shed. At the fourth pick P4, P8, P12, . . . of the same series of picks, one inner weft Wi is inserted into the bottom shed and one patterning weft Wp is inserted into the top shed.

As can be derived from FIG. 2, the position of each pile thread PY, PB1, PB1', . . . at picks P1 to P36 varies between a top position, a middle position and a bottom position, with an approach similar to the one detailed here-above for the method of FIG. 1.

In particular, tying, or anchoring, of the additional fabric F1' to the backing fabric F1 via dead pile thread PF1 occurs at picks P10, P18, P26 and P34. Similarly, anchoring of the additional fabric F2' to the backing fabric F2 via dead pile thread PF2 occurs at picks P9, P17, P25 and P33.

Moreover, interlacing the dead pile threads PP1 and PS1 with patterning wefts Wp, in order to form additional fabric F1', results from the fact that dead pile threads PP1 and PS1 are located on opposite sides of patterning wefts Wp at picks P14, P16, P22, P24, P30 and P32. The same applies for dead pile threads PP2 and PS2 and additional fabric F2', at picks P13, P15, P21, P23, P29 and P31.

In the method represented in FIG. 2, the pile threads form two pile legs D1, D2 in two picks or machine revolutions. This method is more productive than the one of FIG. 1.

Figure 3:
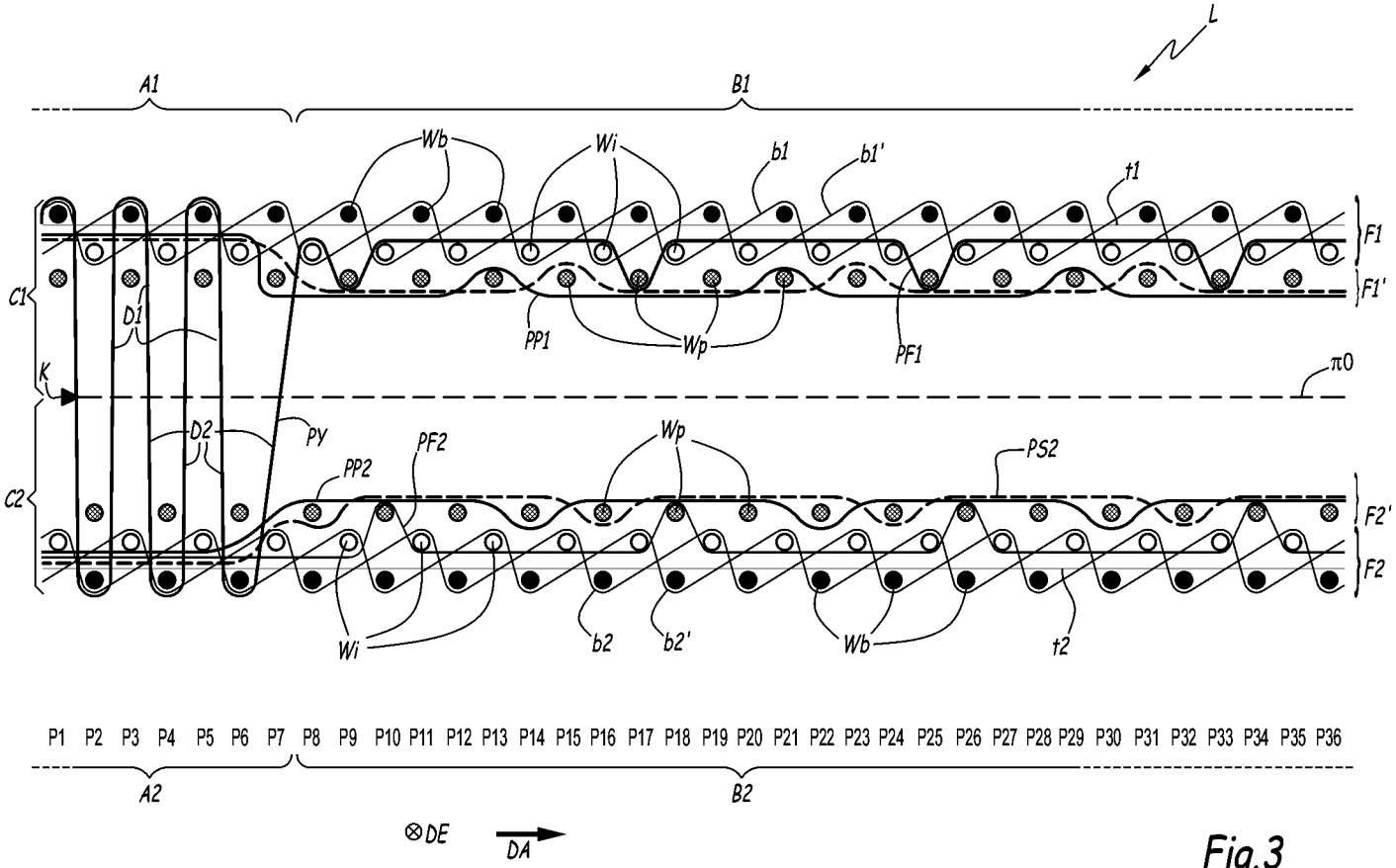

In the third embodiment of the invention represented in FIG. 3, the method is implemented on a face-to-face weaving machine with three weft insertion means, e.g. three rapiers.

Wefts are inserted in successive series of two picks. At a first pick P1, P3, P5, . . . of a series of two picks, one back weft Wb is inserted into the top shed, one patterning weft Wp is inserted into the middle shed and one inner weft Wi is inserted into the bottom shed. Both the back weft Wb and the patterning weft Wp inserted at such a pick are incorporated in the top carpet C1. The inner weft Wi is incorporated into the bottom carpet C2. At a second pick P2, P4, P6, . . . of the same series of picks, one back weft Wb is inserted into the bottom shed, one patterning weft Wp is inserted into the middle shed and one inner weft Wi is inserted into the top shed. Both the back weft Wb and the patterning weft Wp inserted at such a pick are incorporated into the bottom carpet C2. The inner weft Wi is incorporated in the top carpet C1.

As can be derived from FIG. 3, the position of each pile thread PY, PB1, PB1', . . . at picks P1 to P36 varies between a top position, a top middle position, a bottom middle position and a bottom position, with an approach similar to the one detailed here-above for the method of FIG. 1.

Here again, the pile threads form two pile legs D1, D2 in two picks or machine revolutions. This method is very productive and the pile anchoring into the respective backing fabrics F1 and F2 is good, because every patterning pile thread PY is wrapped around a back weft Wb.

Figure 4:
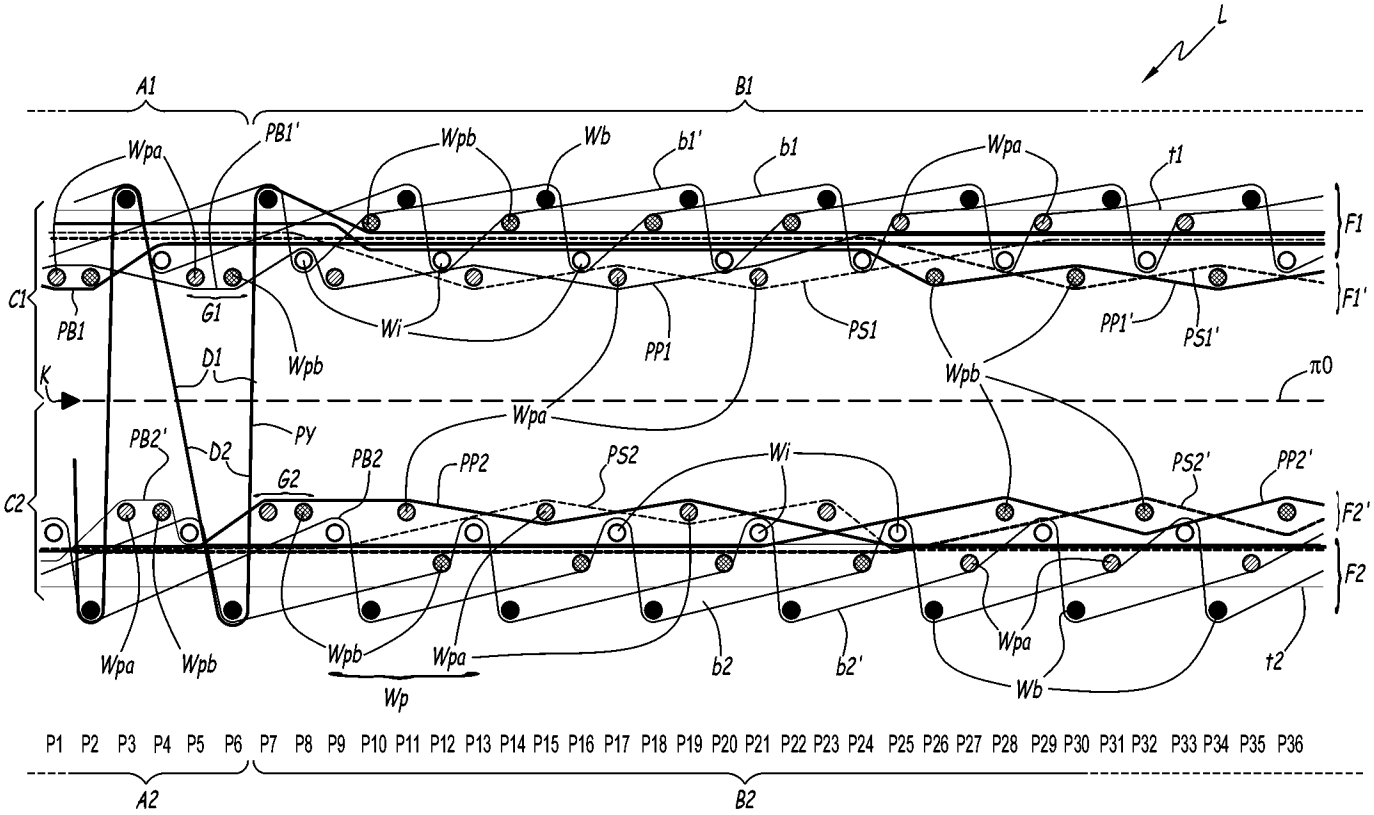
Figure 5:
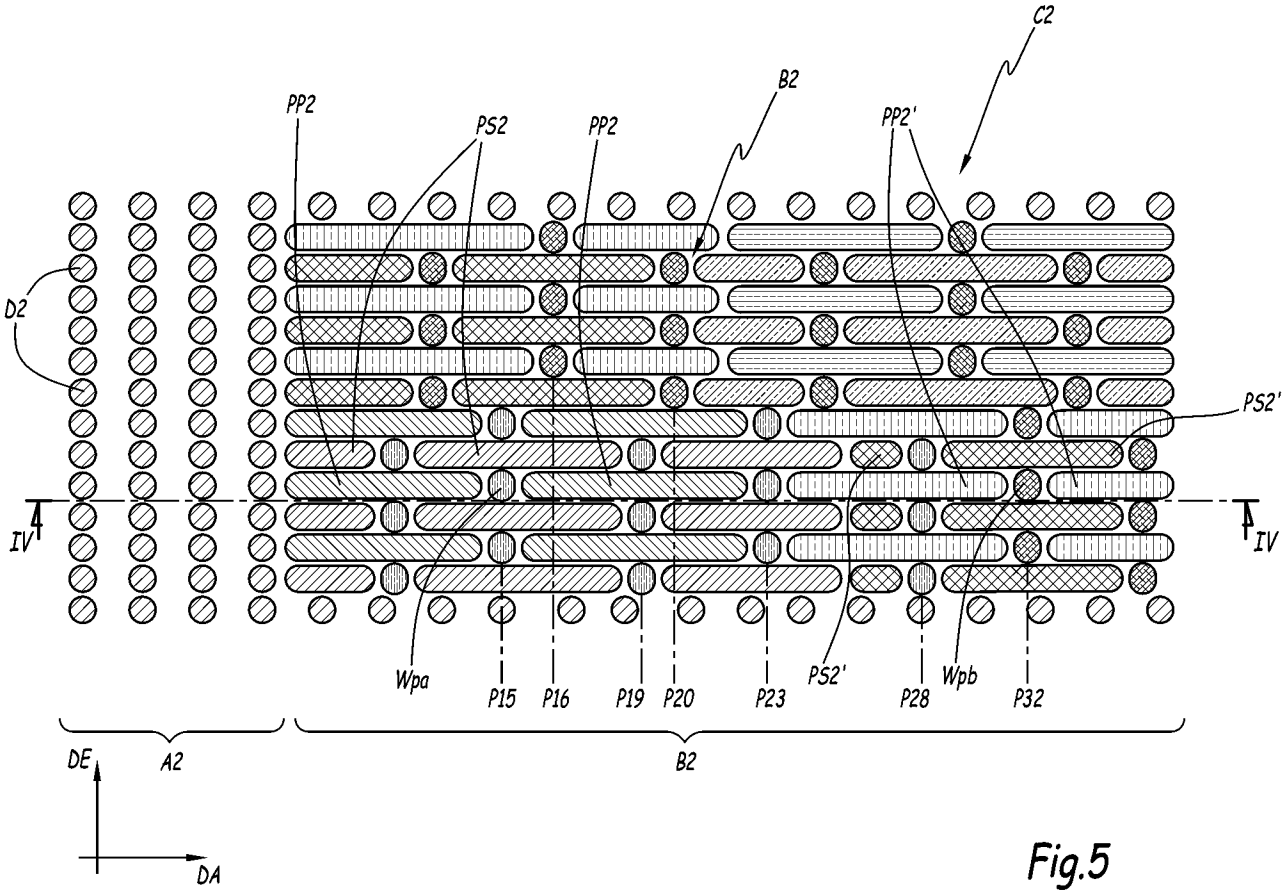
FIG. 5 is a partial top view of a fabric woven with the method of FIG. 4, where the place of the cross section of FIG. 4 is indicated by line IV-IV.

In the fourth embodiment shown in FIGS. 4 and 5, the method is implemented on a face-to-face weaving machine with two insertion means, e.g. two rapiers.

Patterning wefts Wp are divided into two different types of patterning wefts, namely a first type of patterning weft Wpa and a second type of patterning weft Wpb. For instance, the two types of patterning wefts may correspond to different colors of patterning wefts.

Alternatively, the two types of patterning wefts are made of different materials.

The wefts Wi, Wb, Wpa and Wpb are inserted in successive series of four picks. At a first pick P1, P5, . . . of a series of four picks, one patterning weft Wpa of a first type is inserted into the top shed and one inner weft Wi is inserted into the bottom shed. At a second pick P2, P6, . . . of the same series of picks, one patterning weft Wpb of a second type is inserted into the top shed and one back weft Wb is inserted into the bottom shed. At a third pick P3, P7, . . . of the same series of picks, one patterning weft Wpa of the first type is inserted into the bottom shed and one back weft Wb is inserted into the top shed. At a fourth pick P4, P8, . . . of the same series of picks, one patterning weft Wpb of the second type is inserted into the bottom shed and one inner weft Wi is inserted into the top shed.

Patterning wefts Wpa or Wpb alternate along the warp direction DA forming groups G1 and G2 of a patterning weft Wpa of a first type and a patterning weft Wpb of a second type. A group G1 or G2 is formed of two patterning wefts Wpa and Wpb inserted at two successive picks.

As can be derived from FIGS. 4 and 5, the position of each pile thread PY, PB1, PB1', . . . at picks P1 to P36 varies between a top position, a middle position and a bottom position, with an approach similar to the one detailed here-above for the method of FIG. 1. In FIG. 5, the position of some threads is identified as a consequence of some picks P15, P16, P19, P20, P23, P28 and P32 in FIG. 4.

A shown in FIG. 4, patterning wefts Wpa or Wpb can be incorporated into additional fabrics F1' and F2' in different zones of areas B1 and B2. More specifically, between picks P10 and P22, patterning wefts Wpb of the second type are inserted between the additional fabric F1', formed by interlacing the patterning wefts Wpa with the dead pile threads PP1 and PS1, and a part of the backing fabric F1 made of the tension warp thread t1 and the binding warp threads b1 and b1' in the top pile fabric C1 and between the additional fabric F2' and a part of the backing fabric F2 made of the tension warp thread t2 and the binding warp threads b2 and b2' in the bottom pile fabric C2, whereas patterning wefts Wpa of the first type are located inside the additional fabrics F1' and F2'. As shown in FIG. 4, patterning wefts Wpb are, in each backing fabric F1 or F2, interposed between the dead pile threads and the tension warp thread t1 or t2.

In the weft direction DE, zones B1 and B2 can start and end at a different pick, allowing great flexibility in the design, as shown in FIG. 5.

Dead pile threads PP1 and PS1 are woven around the patterning wefts Wpa and located on opposite sides of these patterning wefts respectively at picks P9, P13, P17 and P21 for additional fabric F1' and dead pile threads PP2 and PS2 are woven around the patterning wefts Wpa and located on opposite sides of these patterning wefts respectively at picks P11, P15, P19 and P23 for additional fabric F2'.

As from pick P26, patterning wefts Wpa of the first type are inserted between the additional fabric F1', formed by interlacing the patterning wefts Wpb with the dead pile threads PP1 and PS1 and a part of the backing fabric F1 made of the tension warp thread t1 and the binding warp threads b1 and b1' in the top carpet C1 and between the additional fabric F2' and a part of the backing fabric F2 made of the tension warp thread t2 and the binding warp threads b2 and b2' in the bottom carpet C2, whereas patterning wefts Wpb of the second type are located inside the additional fabrics F1' and F2'. As shown in FIG. 4, patterning wefts Wpa are, in each backing fabric F1 or F2, interposed between the dead pile threads and the tension warp thread t1 or t2.

Two other dead pile threads PP1' and PS1' are used for weaving additional fabric F1' as from pick P24. They can be of a type different from the type of dead pile threads PP1 and PS1. In particular, they can be of a different color.

For example, patterning wefts Wpa and dead pile threads PPS and PS1 can be green, whereas patterning wefts Wpb and dead pile threads PP1' and PS1' are blue. In such a case, additional fabric F1' is green in the part of region B1 woven between picks P9 and P24 and blue in the part of region B1 woven as from pick P25.

Similarly, dead pile threads PP2' and PS2' are used for weaving additional fabric F2' as from pick P24. This allows obtaining also a color effect in additional fabric F2'.

Advantageously, dead pile threads PP1', PS1', PP2' and PP2' respectively belong to the same pile yarn set(s) as pile threads PP1, PS1, PP2 and PS2.

In the top pile fabric C1, the patterning wefts which are not inserted in the additional fabric F1' are inserted between the dead pile warp threads which are not used in the additional fabric F1' and the backing fabric F1 and are hidden. In the bottom pile fabric C2, the patterning wefts which are not inserted in the additional fabric F2' are inserted between the dead pile warp threads which are not used in the additional fabric F2' and the backing fabric F2 and are hidden.

According to a non-represented alternative embodiment of the fourth method of the invention, in the top pile fabric C1, the dead pile warp threads which are not used in the additional fabric F1' could be placed opposite the additional fabric F1' with respect to the patterning wefts Wpb which are not inserted in the additional fabric F1'. In the bottom pile fabric C2, the dead pile warp threads which are not used in the additional fabric F2' could be placed opposite the additional fabric F2' with respect to the patterning wefts Wpb which are not inserted in the additional fabric F2'. In other words patterning wefts Wpb of the second type are inserted between backing fabric F1 and additional fabric F1' and between backing fabric F2 and additional fabric F2', whereas patterning wefts Wpa of the first type belong to the additional fabrics F1' and F2'. Also in this case, patterning wefts Wpb are placed between the first and second dead pile threads PP1, PS1, PP2 or PS2 and the tension warp thread t1 or t2 of the corresponding backing fabric F1 or F2.

Interlacing of the dead pile threads PP1, PS1, PP1' and PS1' with patterning wefts Wp, in order to form additional fabric F1', results from the fact that dead pile threads PP1 and PS1 are located on opposite sides of patterning wefts Wpa at picks P13, P17 and P21 and dead pile threads PP1' and PS1' are located on opposite sides of patterning wefts Wpb at picks P26, P30 and P34. The same applies for dead pile threads PP2, PS2, PP2' and PS2' and additional fabric F2' at picks P11, P15, P19, P23 on the one hand, P28, P32 and P36 on the other hand.

Tying or anchoring of the additional fabrics F1' and F2' to the backing fabrics F1 and F2 results from the switch between dead pile threads PP1 and PS1, and dead pile threads PP1' and PS1' for weaving additional fabric F1'. Before pick P24, dead pile threads PP1 and PS1' are incorporated within backing fabric F1. Similarly, after pick P24, dead pile threads PP1 and PS1 are incorporated within backing fabric F1. The situation is the same for additional fabric F2' and backing fabric F2.

With this method, in the areas B1 and B2 without pile, the additional fabrics F1' and F2' can be woven with the dead pile threads PP1, PS1, PP1', PS1', PP2, PS2, PP2' and PS2' and with the two types of patterning wefts Wpa and Wpb, which allows obtaining further esthetic effects.

The patterning wefts Wpa and Wpb can be made of a different type of yarn and the dead pile threads PP1' and PS1' can be of a material different from the one of dead pile threads PP1 and PS1. The same applies for dead pile threads PP2' and PS2' with respect to dead pile threads PP2 and PS2.

According to a non-represented alternative embodiment of the fourth method of the invention, the patterning wefts Wp can be divided into more than two different types. Also, the number and the types of the dead pile threads PP1, PS1, . . . can be more than two.

As a result, and as shown in FIG. 5 for carpet C2, additional fabric F2' is clearly visible from the top of the carpet in area B2 formed on the right of pile area A2, where pile legs D2 are formed from patterning pile threads PY. The design of this additional fabric F2' is made by interlacing threads PP2, and PS2 and wefts Wp. In this example, the patterning wefts Wp are visible from the top of carpet C2.

Figure 6:
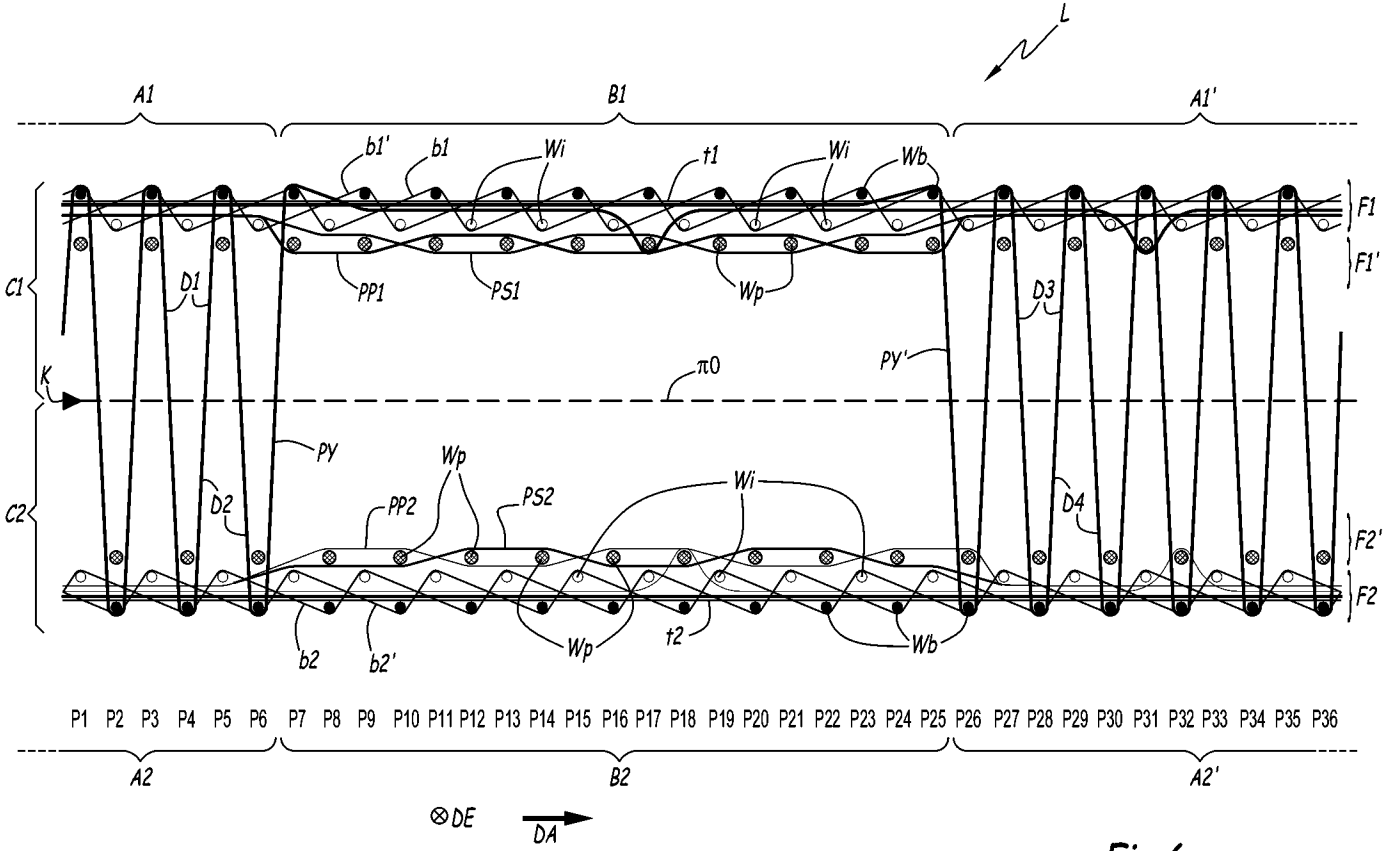
Figure 7:
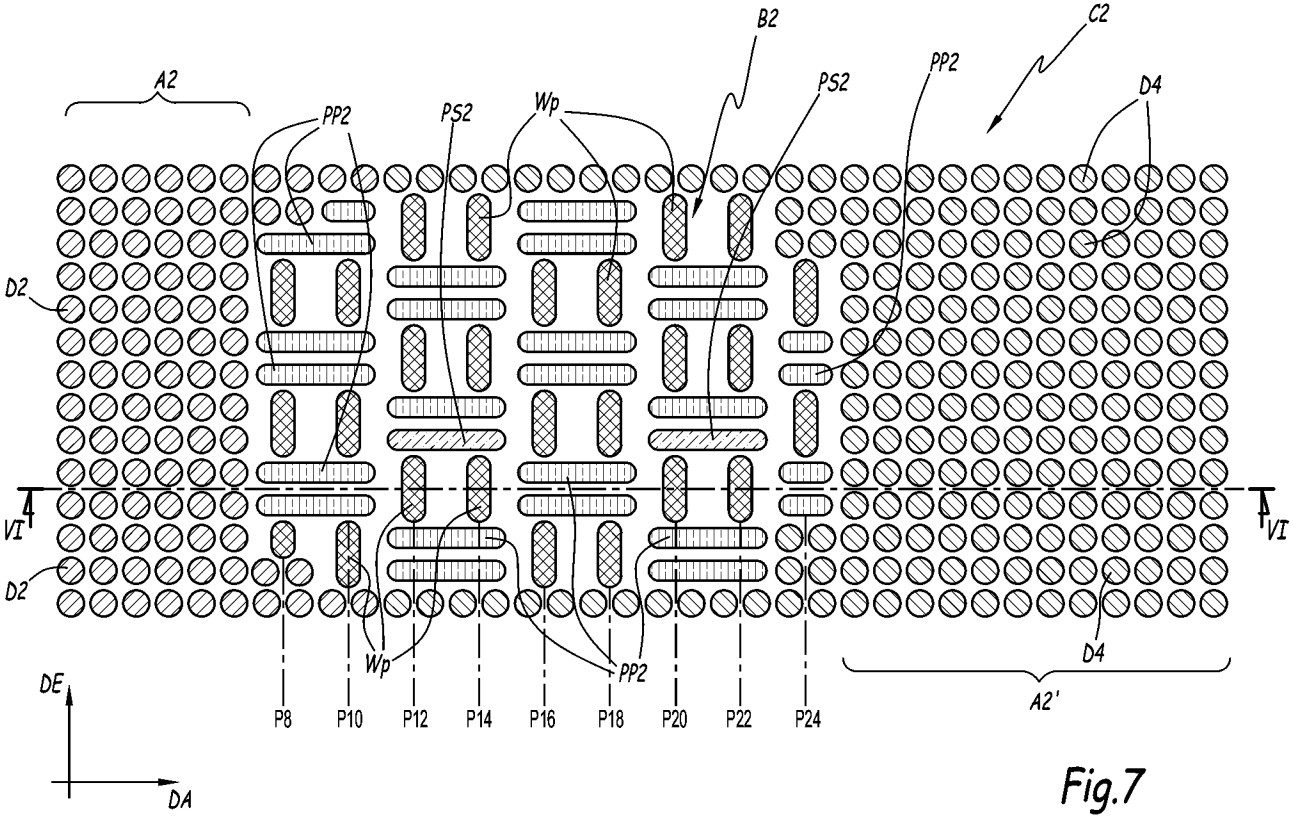
FIG. 7 is a partial top view of a fabric woven with the method of FIG. 6, where the place of the cross section of FIG. 6 is indicated by line VI-VI.

In the fifth embodiment of the invention represented in FIGS. 6 and 7, the method is implemented on a face-to-face weaving machine with three weft insertion means, as in the third embodiment. In particular patterning wefts Wp, inner wefts Wi and back wefts Wb are used, as in the third embodiment. In FIG. 7, the position of some threads is identified as a consequence of some picks P8, P10, P12, P14, P16, P18, P20, P22 and P24 in FIG. 6.

Carpet C1 includes two areas A1 and A1' with pile legs D1 and D3 and one or more area B1 without pile. Similarly, carpet C2 includes two areas A2 and A2' with pile legs D2 and D4 and one area B2 without pile.

Here, between picks P7 and P25, dead pile threads PP1 and PS1 interlaced with patterning wefts Wp form an additional fabric F1' on backing fabric F1 whereas dead pile threads PP2 and PS2 interlaced with patterning wefts Wp form an additional fabric F2' on backing fabric F1.

As a result, and as shown in FIG. 7 for carpet C2, additional fabric F2' is clearly visible from the top of the carpet in area B2 formed between pile areas A2 and A2', where pile legs D2 and D4 are formed from two patterning pile threads PY and PY'. The design of this additional fabric F2' is made by interlacing threads PP2, and PS2 and wefts Wp. In this example, a "basket weave" is used for additional fabric F2'. In other words, the patterning wefts Wp are visible from the top of carpet C2.

In all embodiments, the inner and back wefts Wi and Wb can be made from jute. On the other hand, the pile threads PY, PB1, PB1', PP1, PS1, . . . and the patterning wefts Wp can be made, for example, from polypropylene.

As illustrated in FIGS. 1 to 3 and 5, patterning pile thread PY is used for binding the additional flat fabric F1' in the area B1. Alternatively, this patterning pile thread PY could be used for forming the additional flat fabric F1'.

Irrespective of the embodiment of the invention, an additional flat fabric F1', F2' is formed on the pile side of the backing fabric F1, F2 in the area B1, B2 without pile of carpets C1, C2.

The invention is not limited to the embodiments represented on the figures. In particular, the dead pile threads PP1, PS1, PP2 and PS2 forming the additional flat fabric F1' or F2' can pattern according to a plain weave.

The number of areas with piles A1 and A2 and areas without pile B1 and B2 of each carpet C1 and C2 can be adapted, according to the needs. This number is one or more.

The number of tension warp threads and binding warp threads in the backing fabrics F1 and F2 can be adapted according to the needs. This number is one or more.

The invention is represented in all the figures, except for FIGS. 6 and 7, with a single patterning pile thread PY. Actually, the number of patterning pile thread(s) can be adapted according to the needs and the pile pattern to be obtained on the carpets C1 and C2.

The technical features of the embodiments and alternative embodiments considered here-above can be combined in order to generate new embodiments of the invention.

The invention claimed is:

1. Method for simultaneously weaving, on a face-to-face weaving machine, two pile fabrics each including at least one area with pile and at least one area without pile, wherein:

a top backing fabric and a bottom backing fabric are woven one above the other, each with:

at least one tension warp thread, at least one binding warp thread, inner wefts, which are inserted between the binding warp thread and the tension warp thread on a pile side of the tension warp thread, back wefts, which are inserted between the binding warp thread and the tension warp thread on a back side of the tension warp thread, opposite to the pile of the fabric, patterning wefts, are inserted on a pile side of the tension warp threads, outside of the backing fabric, at least one patterning pile threads is interlaced in the upper backing fabric and in the lower backing fabric, in order to form pile legs in the area with pile, wherein, for at least one pick, corresponding to the area without pile, at least a first dead pile thread is placed between the backing fabric and a patterning weft and a second dead pile thread is placed opposite the backing fabric with respect to the same patterning weft, wherein an additional fabric is formed in the area without pile by the first and second dead pile threads woven with the patterning wefts and wherein this additional fabric covers the backing fabric.

2. The method according to claim 1, wherein the pile threads are grouped, along the weft direction, in pile yarn sets going through a same reed dent space of a reed of the face-to-face weaving machine, and wherein the first dead pile thread and the second dead pile thread, which are placed on either side of a same patterning weft during said at least one pick, belong to the same pile yarn set.

3. The method according to claim 1, wherein the pile threads are organized, along the weft direction, in respective pile yarn sets with all pile warp threads of one pile yarn set going through a same reed dent space of a reed of the face-to-face weaving machine, and wherein the first dead pile thread and the second dead pile thread, which are placed on either side of a same patterning weft during said at least one pick, belong to different warp yarn sets.

4. The method according to claim 1, wherein an area without pile is woven with several adjacent pile yarn sets.

5. The method according to claim 1, wherein during weaving of the area without pile, a dead pile thread follows a tying path where, for at least one pick, it is placed between an inner weft and a back weft of the backing fabric and, for at least another pick, it is placed opposite the backing fabric with respect to a patterning weft.

6. The method according to claim 5, wherein, at the other pick where the dead pile thread is placed opposite the backing fabric with respect to the patterning weft, another dead pile thread, which belongs to the same pile yarn set as the dead pile thread following the tying path, is placed opposite the backing fabric with respect to a patterning weft.

7. The method according to claim 1, wherein it is implemented on a weaving machine with two weft insertion means and that wefts are inserted into a top shed and into a bottom shed formed on the loom, during successive series of three picks.

8. The method according to claim 7, wherein at a first pick of a series of three picks, one patterning weft is inserted into each shed;

at a second pick of the same series, one back weft is inserted into the top shed and one inner weft is inserted into the bottom shed; and at a third pick of the same series, one inner weft is inserted into the top shed and one back weft is inserted into the bottom shed.

9. The method according to claim 1, wherein it is implemented on a weaving machine with two weft insertion means and that wefts are inserted into a top shed and into a bottom shed formed on the loom, during successive series of four picks.

10. The method according to claim 9, wherein at a first pick of a series of four picks, one back weft is inserted into the top shed and one patterning weft is inserted into the bottom shed;

at a second pick of the same series, one back weft is inserted into the bottom shed and one patterning weft is inserted into the top shed;

at a third pick of the same series, one inner weft is inserted into the top shed and one patterning weft is inserted into the bottom shed; and at the fourth pick of the same series, one inner weft is inserted into the bottom shed and one patterning weft is inserted into the top shed.

11. The method according to claim 1, wherein it is implemented on a weaving machine with three weft insertion means and that wefts are inserted into a top shed, into a middle shed and into a bottom shed formed on the loom, during successive series of two picks.

12. The method according to claim 11, wherein at the first pick of a series of two picks, one back weft is inserted into the top shed, one patterning weft is inserted into the middle shed and one inner weft is inserted into the bottom shed and both the back weft and the patterning weft are incorporated into the top pile fabric; and at a second pick of the same series, one back weft is inserted into the bottom shed, one patterning weft is inserted into the middle shed and one inner weft is inserted into the top shed and both the back weft and the patterning weft are incorporated into the bottom pile fabric.

13. The method according to claim 1, wherein the patterning wefts are divided into at least two different types of patterning wefts, in particular patterning wefts of different colours or materials which alternate along the warp direction forming groups of patterning wefts.

14. The method according to claim 13, wherein for at least one pick corresponding to the area without pile, at least a first dead pile warp thread is placed between the backing fabric and a patterning weft of a first type and a second dead pile warp thread is placed opposite the backing fabric with respect to the same patterning weft of a first type and wherein the patterning weft of a second type of the same group is placed between the first and second dead pile threads and the tension warp thread.

15. The method according to claim 13, wherein it is it is implemented on a weaving machine with two weft insertion means and that wefts are inserted into a top shed and into a bottom shed formed on the loom, during successive series of four picks.

16. The method according to claim 15, wherein at a first pick of a series of four picks, one patterning weft of a first type is inserted into the top shed and one inner weft is inserted into the bottom shed;

at a second pick of the same series, one patterning weft of a second type is inserted into the top shed and one back weft is inserted into the bottom shed;

at a third pick of the same series, one patterning weft of the first type is inserted into the bottom shed and one back weft is inserted into the top shed; and at a fourth pick of the same series, one patterning weft of the second type is inserted into the bottom shed and one inner weft is inserted into the top shed.

17. The method according to claim 13, wherein, in an area without pile, dead pile threads of two different types are respectively woven with the two types of patterning wefts.

18. A pile fabric including at least one area with pile and at least one area without pile, said pile fabric comprising:

a backing fabric woven with:

at least one tension warp thread, at least one binding warp thread, inner wefts, which are inserted between the binding warp thread and the tension warp thread on the pile side of the fabric, back wefts, which are inserted between the binding warp thread and the tension warp thread on a back side of the tension warp thread, opposite to the pile side of the fabric, patterning wefts, which are inserted on a pile side of the tension warp threads, outside of the backing fabric, pile legs in the area with pile, wherein said pile fabric includes, in the area without pile, an additional fabric different from the backing fabric and woven with a weaving scheme where at least a first dead pile thread is located between the backing fabric and a patterning weft and a second dead pile thread is located opposite the backing fabric with respect to the same patterning weft, this weaving scheme being used several times in the weft direction.

19. The pile fabric of claim 18, wherein, in the area without pile, a dead pile thread follows a path where, in a first zone of the area without pile, it is located between an inner weft and a back weft of the backing fabric and, in another zone of the area without pile, it is located opposite the backing fabric with respect to a patterning weft.

20. The pile fabric of claim 18, wherein the patterning wefts are divided into at least two different types of patterning wefts, in particular patterning wefts of different colours or materials.

* * * * *